US010596689B2

(12) United States Patent
Lewis

(10) Patent No.: US 10,596,689 B2
(45) Date of Patent: Mar. 24, 2020

(54) ENGINE SERVICING SYSTEM

(71) Applicant: Glenn Lewis, Ladysmith, CA (US)

(72) Inventor: Glenn Lewis, Ladysmith, CA (US)

( * ) Notice: Subject to any disclaimer, the term of this patent is extended or adjusted under 35 U.S.C. 154(b) by 191 days.

(21) Appl. No.: 15/792,428

(22) Filed: Oct. 24, 2017

(65) Prior Publication Data

US 2019/0118358 A1 Apr. 25, 2019

(51) Int. Cl.

| | |
|---|---|
| ***B25B 27/26*** | (2006.01) |
| ***B25B 27/00*** | (2006.01) |
| ***F01L 1/46*** | (2006.01) |
| ***F02F 1/24*** | (2006.01) |

(52) U.S. Cl.

CPC ..... *B25B 27/26* (2013.01); *B25B 27/0035* (2013.01); *F01L 1/462* (2013.01); *F01L 2103/01* (2013.01); *F01L 2800/17* (2013.01); *F01L 2820/01* (2013.01); *F02F 1/24* (2013.01); *F02F 2200/00* (2013.01)

(58) Field of Classification Search

CPC ..... B25B 27/00; B25B 27/0035; B25B 27/24; B25B 27/26; Y10T 29/53552; Y10T 29/5361–53587; Y10T 29/53613

USPC ..... 29/215, 213.1, 216

See application file for complete search history.

(56) References Cited

U.S. PATENT DOCUMENTS

| | | | | |
|---|---|---|---|---|
| 1,323,476 | A * | 12/1919 | Ingram | B25B 27/26 29/219 |
| 3,038,247 | A | 6/1962 | Clark | |
| 5,042,128 | A | 8/1991 | Barbour | |
| 5,689,870 | A | 11/1997 | Robey | |
| D511,661 | S | 11/2005 | Higdon | |
| 7,181,818 | B1 * | 2/2007 | Qualman | B25B 27/24 29/213.1 |
| 7,765,664 | B2 | 8/2010 | Duarte | |
| 8,397,361 | B1 * | 3/2013 | Irving | B25B 27/26 219/215 |
| 9,327,393 | B1 | 5/2016 | DePyssler | |

* cited by examiner

*Primary Examiner* — Orlando E Aviles
*Assistant Examiner* — Thomas Raymond Rodgers

(57) ABSTRACT

An engine servicing system includes a motorcycle that has an engine. The engine has a cylinder head, an intake valve and an exhaust valve. A mount is provided and the mount is selectively coupled to the cylinder head. A plurality of bolts is provided and each of the bolts extends through the mount and engages the cylinder head at predetermined points on the cylinder head to retain the mount on the cylinder head. A compression unit is provided and the compression unit is removably coupled to the mount. The compression unit engages each of the intake valve and the exhaust valve such that the compression unit selectively compresses each of the intake valve and the exhaust valve. In this way each of the intake valve and the exhaust valve may be serviced while the engine is mounted in the motorcycle and without removing the cylinder head from the engine.

15 Claims, 5 Drawing Sheets

ENGINE SERVICING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to servicing devices and more particularly pertains to a new servicing device for servicing intake valves and exhaust valves on a V-Twin engine.

BRIEF SUMMARY OF THE INVENTION

An embodiment of the disclosure meets the needs presented above by generally comprising a motorcycle that has an engine. The engine has a cylinder head, an intake valve and an exhaust valve. A mount is provided and the mount is selectively coupled to the cylinder head. A plurality of bolts is provided and each of the bolts extends through the mount and engages the cylinder head at predetermined points on the cylinder head to retain the mount on the cylinder head. A compression unit is provided and the compression unit is removably coupled to the mount. The compression unit engages each of the intake valve and the exhaust valve such that the compression unit selectively compresses each of the intake valve and the exhaust valve. In this way each of the intake valve and the exhaust valve may be serviced while the engine is mounted in the motorcycle and without removing the cylinder head from the engine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
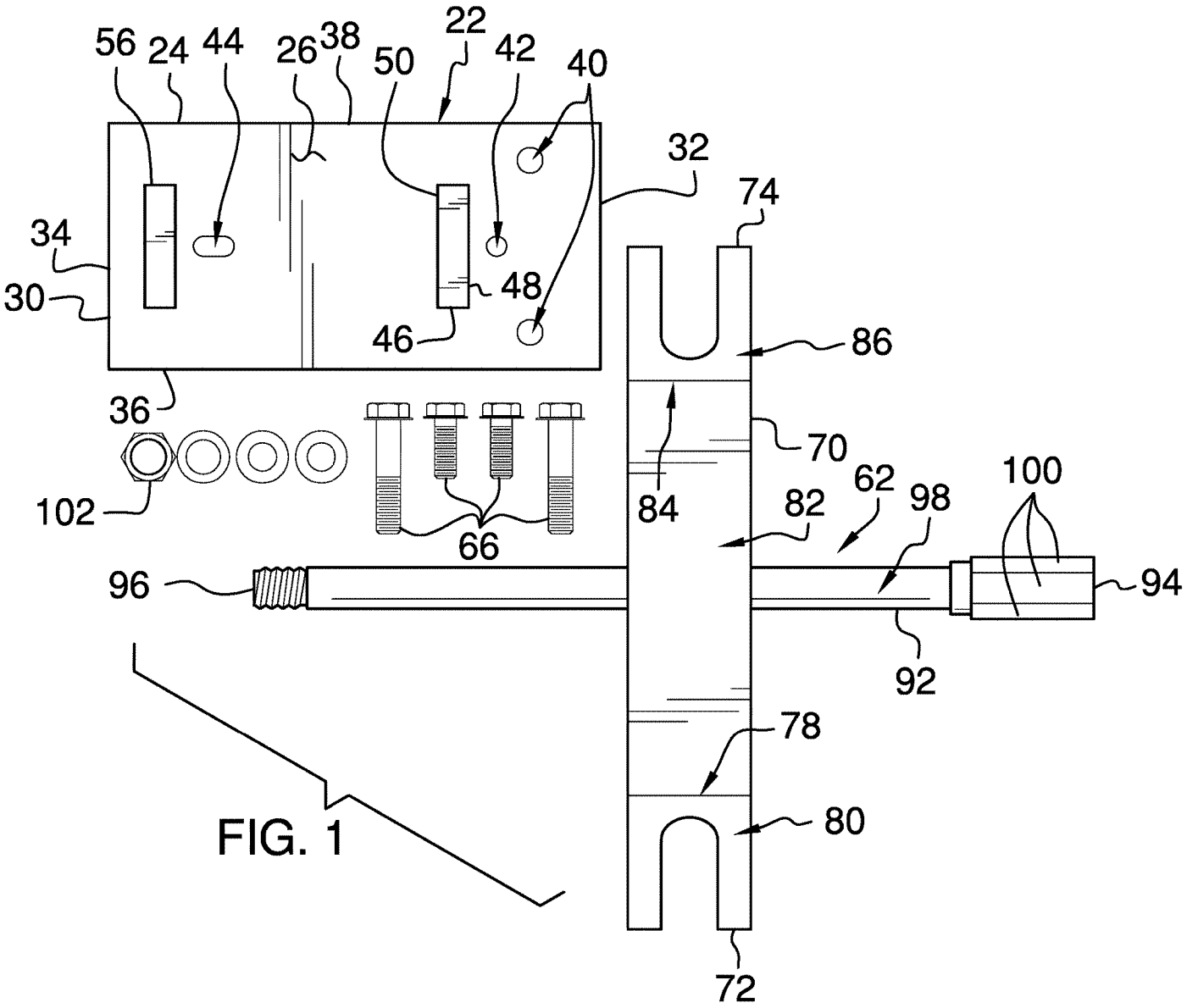
FIG. 1 is a kit view of a mount, a compression unit and bolts of an engine servicing system according to an embodiment of the disclosure.
Figure 2:
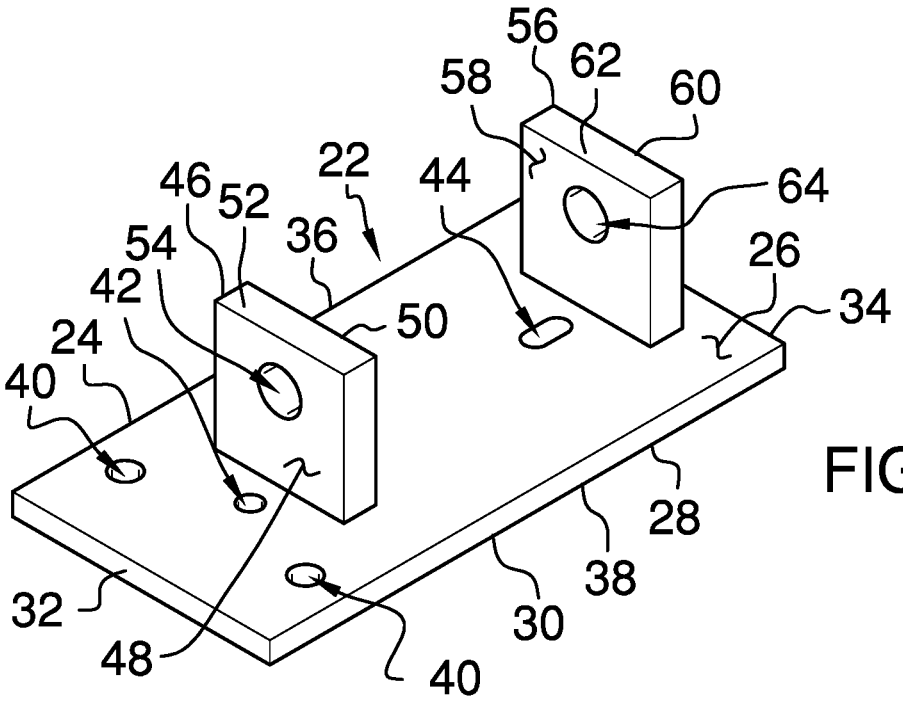
FIG. 2 is a top perspective view of a mount of an embodiment of the disclosure.
Figure 3:
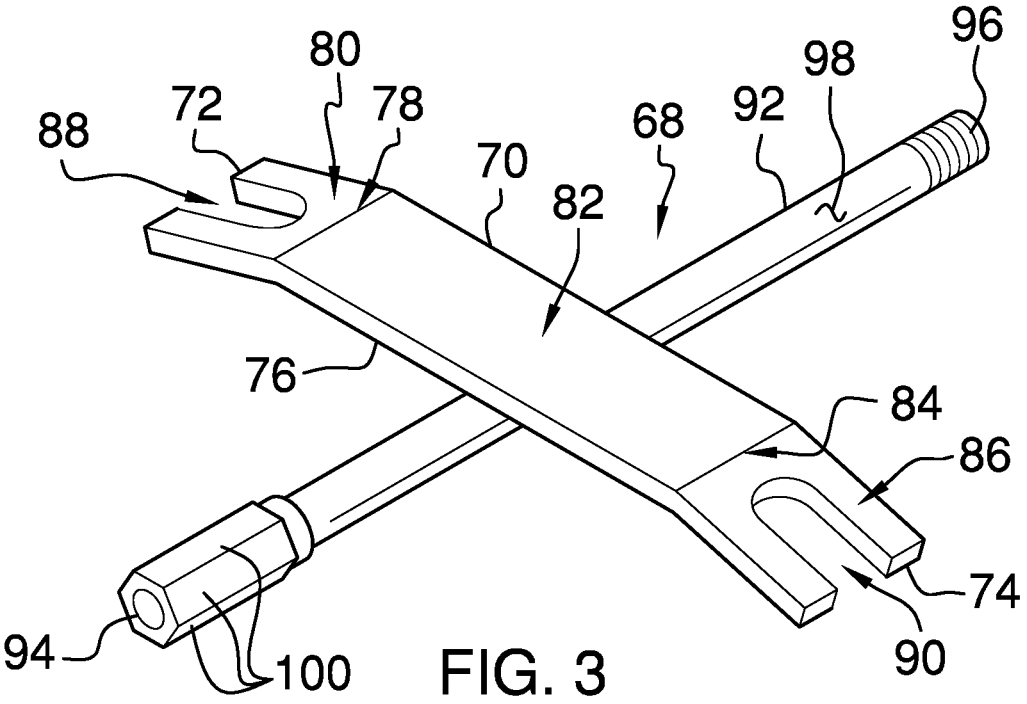
FIG. 3 is a perspective view of compression unit of an embodiment of the disclosure.
Figure 4:
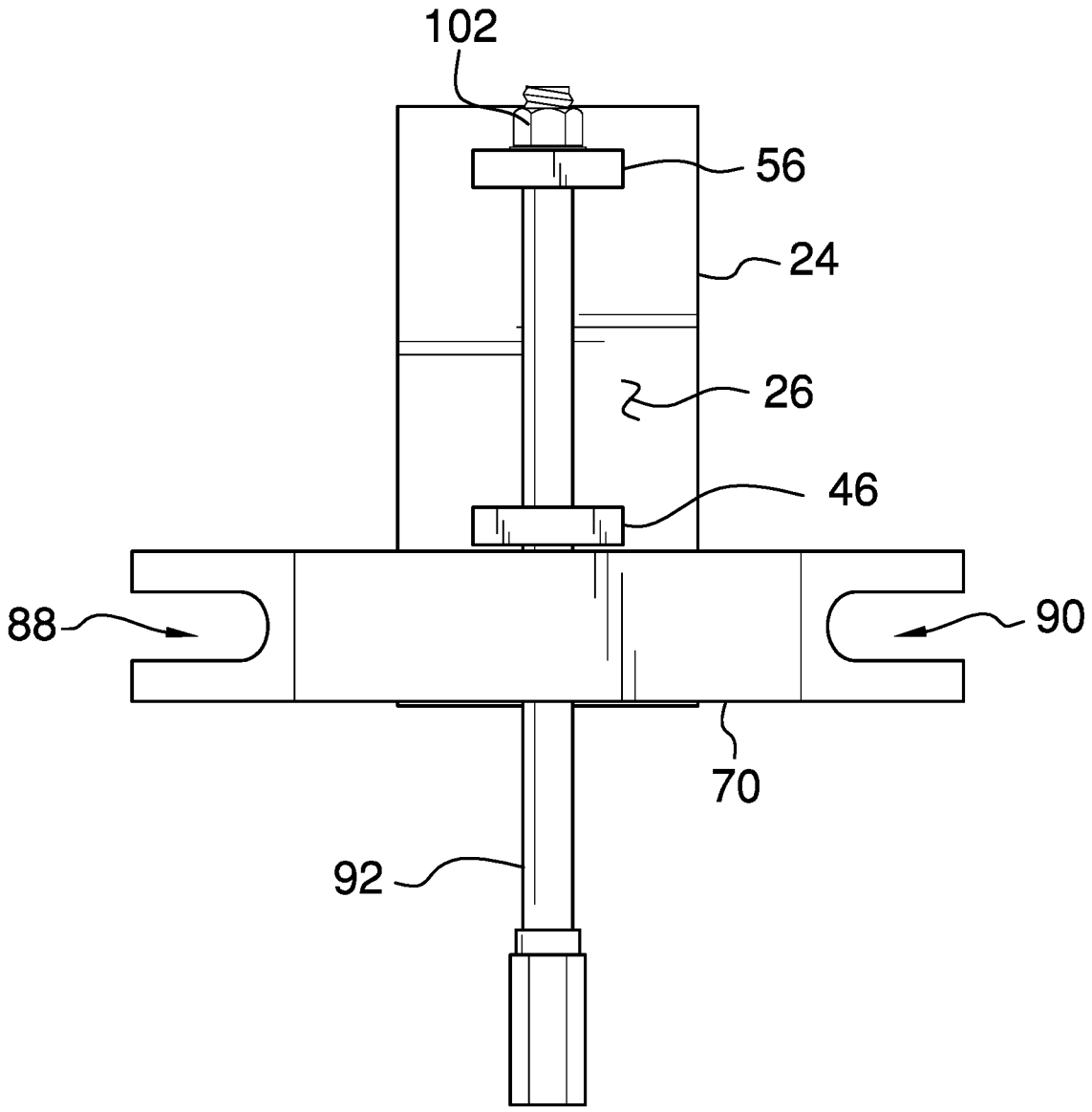
FIG. 4 is a top view of mount and a compression unit of an embodiment of the disclosure.
Figure 5:
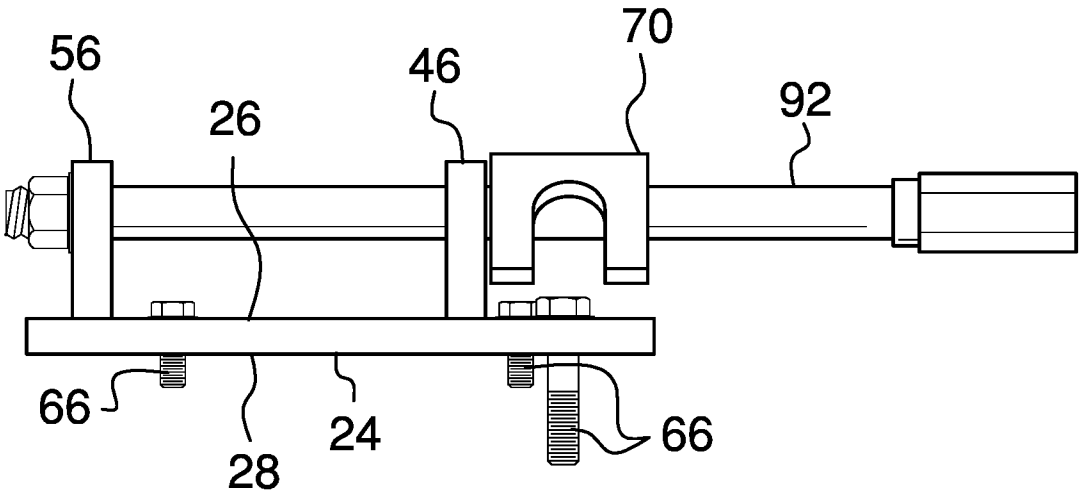
FIG. 5 is a right side view of mount and a compression unit of an embodiment of the disclosure.
Figure 6:
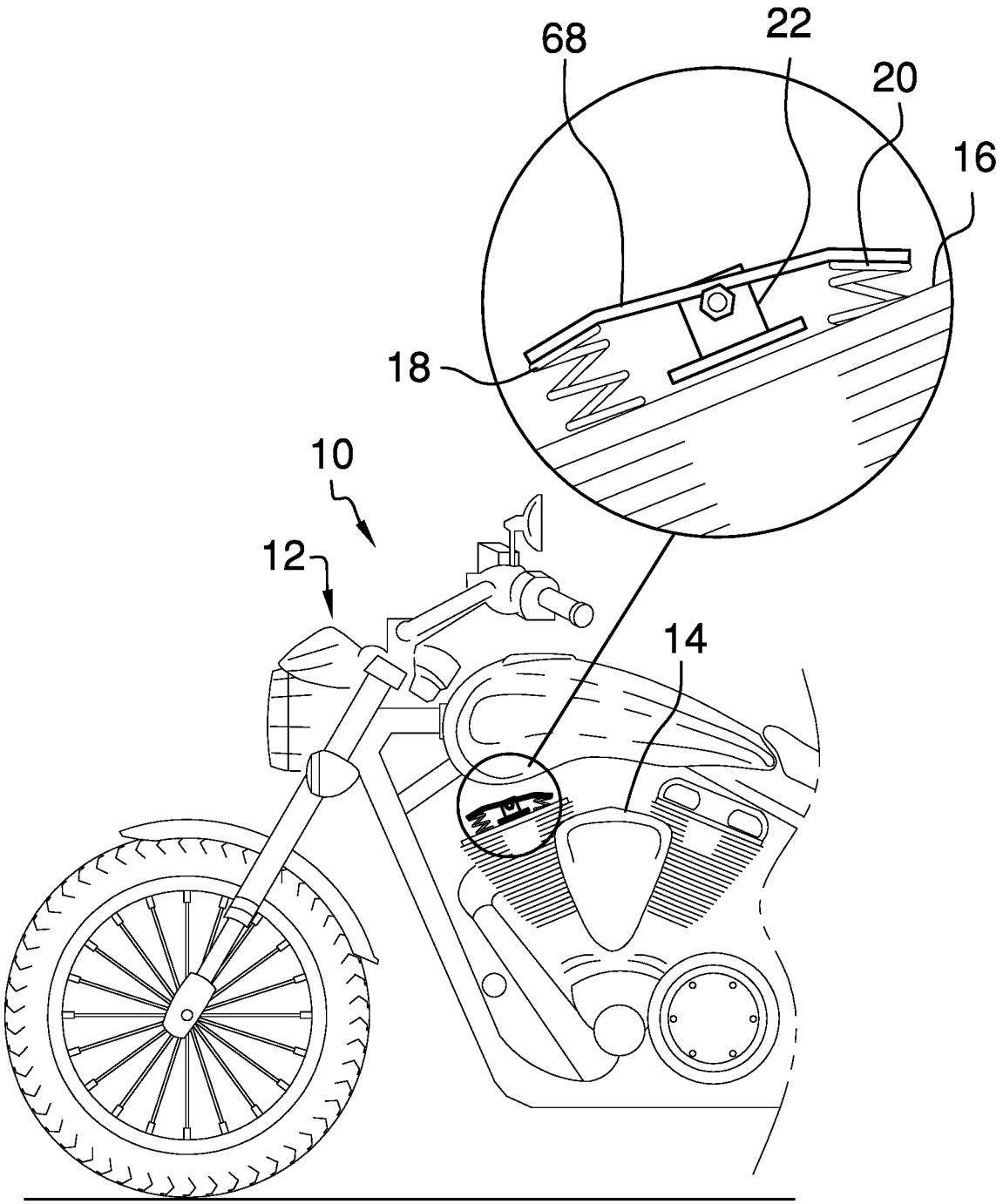
FIG. 6 is a perspective in-use view of an embodiment of the disclosure.

With reference now to the drawings, and in particular to FIGS. 1 through 6 thereof, a new servicing device embodying the principles and concepts of an embodiment of the disclosure and generally designated by the reference numeral 10 will be described.

As best illustrated in FIGS. 1 through 6, the engine servicing system 10 generally comprises a motorcycle 12 that has an engine 14. The engine 14 has a cylinder head 16, an intake valve 18 and an exhaust valve 20. The motorcycle 12 may be a HARLEY DAVIDSON brand motorcycle and the engine 14 may be a V-TWIN engine. Moreover, the engine 14 may be an EVOLUTION engine produced by HARLEY DAVIDSON motor company and a TWIN CAM engine produced by HARLEY DAVIDSON motor company.

A mount 22 is provided and the mount 22 is selectively coupled to the cylinder head 16 while the engine 14 is mounted on the motorcycle 12. The mount 22 comprises a first plate 24 that has a first surface 26, a second surface 28 and a perimeter edge 30 extending therebetween. The perimeter edge 30 has a first lateral side 32, a second lateral side 34, a front side 36 and a back side 38. The first plate 24 may have a length of approximately 15.0 cm and a width of approximately 8.0 cm.

The first plate 24 has a pair of first apertures 40 each extending through the first surface 26 and the second surface 28 and each of the first apertures 40 is positioned closer to the first lateral side 32 than the second lateral side 34. Each of the first apertures 40 is spaced apart from each other and is aligned with each other. Additionally, each of the first apertures 40 may have a diameter of approximately 7.9 mm. The first apertures 40 may each be spaced from the first lateral side 32 a distance of approximately 22.0 mm and the first apertures 40 may be spaced apart from each other a distance of approximately 5.3 cm The first plate 24 has a second aperture 42 extending through the first surface 26 and the second surface 28 and the second aperture 42 is centrally positioned between each of the first apertures 40. Moreover, the second aperture 42 is positioned closer to the first apertures 40 than the second lateral side 34. The second aperture 42 may have a diameter of approximately 6.3 mm and the second aperture 42 may be spaced from the first lateral side 32 a distance of approximately 2.3 cm.

The first plate 24 has a third aperture 44 extending through the first surface 26 and the second surface 28 and the third aperture 44 is aligned with the second aperture 42. Additionally, the third aperture 44 is positioned closer to the second lateral side 34 than the second aperture 42. The third aperture 44 may be spaced from the second lateral side 34 a distance of approximately 3.1 cm. The third aperture 44 is elongated between the first lateral side 32 and the second lateral side 34 such that the third aperture 44 has an ovoid shape. Additionally, the third aperture 44 may have a length of approximately 1.3 cm.

A second plate 46 is provided that has a primary surface 48, a secondary surface 50 and a peripheral edge 52 extending therebetween. The peripheral edge 52 is coupled to the first surface 26 of the first plate 24 and the second plate 46 is oriented perpendicular to the first plate 24. The second plate 46 has a fourth aperture 54 extending through the primary surface 48 and the secondary surface 50. The fourth aperture 54 may have a diameter of approximately 1.3 cm and the fourth aperture 54 may be spaced from the first plate 24 a distance of approximately 2.4 cm. The second plate 46 extends between the front side 36 and the back side 38 of the first plate 24 and the second plate 46 is centrally positioned between the front side 36 and the back side 38. Moreover, the second plate 46 is positioned closer to the second aperture 42 in the first plate 24 than the third aperture 44 in the first plate 24. The second plate 46 may be spaced from the second lateral side 34 of the first plate 24 a distance of approximately 9.5 cm.

A third plate 56 is provided that has a primary surface 58, a secondary surface 60 and a peripheral edge 62 extending therebetween. The peripheral edge 62 of the third plate 56 is coupled to the first surface 26 of the first plate 24 and the third plate 56 is oriented perpendicular to the first plate 24. The third plate 56 has a fifth aperture 64 extending through the primary surface 48 and the secondary surface 50 of the third plate 56. The fifth aperture 64 may have a diameter of approximately 1.3 cm the fifth aperture 64 may be spaced from the first plate 24 a distance of approximately 2.4 cm.

The third plate 56 extends between the front side 36 and the back side 38 of the first plate 24. The third plate 56 is positioned between the third aperture 44 on the first plate 24 and the second lateral side 34. Moreover, the third plate 56 is aligned with the second plate 46 such that the fifth aperture 64 is aligned with the fourth aperture 54. The third plate 56 may be spaced from the second lateral side 34 of the first plate 24 a distance of approximately 1.6 cm.

A plurality of bolts 66 is provided and each of the bolts 66 is selectively extended through the mount 22 to engage the cylinder head 16 at predetermined points on the cylinder head 16. In this way the mount 22 is retained on the cylinder head 16. Each of the bolts 66 may engage the cylinder head 16 at locations where pre-existing bolts have been removed from the cylinder head 16. The bolts 66 are extended through each of the first apertures 40 and the second aperture 42 when the mount 22 is coupled to the Evolution engine 14. The bolts 66 are extended through each of the first apertures 40, the second aperture 42 and the third aperture 44 when the mount 22 is coupled to the Twin Cam engine 14.

A compression unit 68 is provided and the compression unit 68 is removably coupled to the mount 22. The compression unit 68 engages each of the intake valve 18 and the exhaust valve 20 when the compression unit 68 is coupled to the mount 22. Moreover, the compression unit 68 selectively compresses each of the intake valve 18 and the exhaust valve 20 thereby facilitating each of the intake valve 18 and the exhaust valve 20 to be serviced. Additionally, the compression unit 68 facilitates the intake valve 18 and the exhaust valve 20 to be serviced while the engine 14 is mounted in the motorcycle 12 and without removing the cylinder head 16 from the engine 14.

The compression unit 68 comprises a fourth plate 70 that has a first end 72, a second end 74 and a bottom surface 76. The fourth plate 70 is elongated between the first end 72 and the second end 74. The fourth plate 70 has a first bend 78 thereon to define a first end portion 80 of the fourth plate 70 forming an angle with a central portion 82 of the fourth plate 70. The first bend 78 is positioned closer to the first end 72 than the second end 74. The fourth plate 70 has a second bend 84 thereon to define a second end portion 86 of the fourth plate 70 forming an angle with the central portion 82. The second bend 84 is positioned closer to the second end 74 than the first end 72.

Each of the first end portion 80 and the second end portion 86 may have a length of approximately 4.1 cm. The central portion 82 may have a length of approximately 12.8 cm. Each of the first end portion 80 and the second end portion 86 may form an angle of approximately 16° with respect to the central portion 82. The first end 72 has a first slot 88 extending toward the second end 74 and the second end 74 has a second slot 90 extending toward the first end 72.

A rod 92 is provided that has a primary end 94, a secondary end 96 and an outer surface 98 extending therebetween. The rod 92 is elongated between the primary end 94 and the secondary end 96. Moreover, the outer surface 98 is bonded to the bottom surface 76 of the fourth plate 70 having the rod 92 being oriented perpendicular to a line extending through the first end 72 and the second end 74 of the fourth plate 70. Additionally, the rod 92 is centrally positioned between the first end 72 and the second end 74 and the plate is centrally positioned between the primary end 94 and the secondary end 96.

The outer surface 98 is threaded adjacent to the secondary end 96. The outer surface 98 has a plurality of intersecting sides 100 adjacent to the primary end 94 thereby facilitating the plurality of intersecting sides 100 to be engaged by a wrench. The rod 92 may have a length of approximately 25 cm. The intersecting sides 100 of the outer surface 98 may have a length of approximately 5 cm and the intersecting sides 100 of the outer surface 98 may be arranged to facilitate a ¾ inch wrench.

The rod 92 is extended through the fourth aperture 54 in the second plate 46 and the fifth aperture 64 in the third plate 56. Moreover, each of the intake valve 18 and the exhaust valve 20 is positioned in an associated one of the first slot 88 and the second slot 90. The rod 92 is selectively rotated to compress a selected one of the intake valve 18 and the exhaust valve 20 for service. A threaded nut 102 is provided in the threaded nut 102 threadably engages the secondary end 96 of the rod 92 when the rod 92 it is extended through the second plate 46 in the third plate 56 to retain the rod 92 in the mount 22.

In use, rocker boxes are removed from the cylinder heads 16 on the engine 14. A camshaft in the engine 14 is inhibited from rotating through any selected means. The mount 22 is attached to a selected one of the cylinder heads 16 using the bolts 66. The rod 92 is extended through each of the second plate 46 and the third plate 56 such that each of the first slot 88 and the second slot 90 engages the associated intake valve 18 and exhaust valve 20.

The rod 92 is selectively rotated to compress a valve spring on a selected one of the intake valve 18 and the exhaust valve 20. In this way the valve spring may be removed, replaced and otherwise serviced without removing the cylinder heads 16 from the engine 14. Additionally, the valve spring on each of the intake valve 18 in the exhaust valve 20 may be removed, replaced and otherwise serviced without removing the engine 14 from the motorcycle 12. In this way each of the mount 22 and the compression unit 68 reduces the amount of time required to remove, replace and otherwise service the valve springs on each of the intake valve 18 and the exhaust valve 20.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An engine servicing system for compressing valve springs on an assembled engine, said system comprising:

a motorcycle having an engine, said engine having a cylinder head, an intake valve and an exhaust valve;

a mount being selectively coupled to said cylinder head, said mount comprising a first plate, a second plate coupled to said first plate, said second plate being perpendicular to said first plate, a third plate, said third plate being perpendicular to said second plate and positioned in spaced relationship parallel to and aligned with said second plate;

a plurality of bolts, each of said bolts extending through said mount and engaging said cylinder head at predetermined points on said cylinder head to retain said mount on said cylinder head; and a compression unit being removably coupled to said mount wherein said compression unit is configured to be manipulated, said compression unit engaging each of said intake valve and said exhaust valve such that said compression unit selectively compresses each of said intake valve and said exhaust valve thereby facilitating each of said intake valve and said exhaust valve to be serviced while said engine is mounted in said motorcycle without removing said cylinder head from said engine, said compression unit comprising a rod, said rod being extended perpendicularly through said second plate and said third plate wherein said rod is rotatable relative to each of said second plate and said third plate, said rod having a primary end, a secondary end, and an outer surface extending therebetween, said outer surface having a plurality of intersecting sides adjacent to said primary end wherein said plurality of intersecting sides is configured to be engaged by a wrench to facilitate rotation of said rod, and a fourth plate, said fourth plate having a first end and a second end, said fourth plate being coupled to said rod having said rod being oriented perpendicular to a line extending through said first end and said second end of said fourth plate wherein said fourth plate is pivoted by rotation of said rod relative to said second plate and said third plate, said first end of said fourth plate and said second end of said fourth plate being positioned on opposite sides of said rod wherein the first end and the second end are configured to simultaneously engage a respective one of the intake valve and the exhaust valve.

2. The system according to claim 1, wherein said mount comprises said first plate having a first surface, a second surface and a perimeter edge extending therebetween, said perimeter edge having a first lateral side, a second lateral side, a front side and a back side, said first plate having a pair of first apertures extending through said first surface and said second surface, each of said first apertures being positioned closer to said first lateral side than said second lateral side, each of said first apertures being spaced apart from each other and being aligned with each other.

3. The system according to claim 2, wherein said first plate has a second aperture extending through said first surface and said second surface, said second aperture being centrally positioned between each of said first apertures, said second aperture being positioned closer to said first apertures than said second lateral side.

4. The system according to claim 3, wherein said first plate has a third aperture extending through said first surface and said second surface, said third aperture being aligned with said second aperture, said third aperture being positioned closer to said second lateral side than said second aperture, said third aperture being elongated between said first lateral side and said second lateral side such that said third aperture has an ovoid shape.

5. The system according to claim 4, further comprising said second plate having a primary surface, a secondary surface and a peripheral edge extending therebetween, said peripheral edge being coupled to said first surface of said first plate.

6. The system according to claim 5, wherein said second plate has a fourth aperture extending through said primary surface and said secondary surface, said second plate extending between said front side and said back side of said first plate, said second plate being positioned closer to said second aperture in said first plate than said third aperture in said first plate.

7. The system according to claim 6, further comprising said third plate having a primary surface, a secondary surface and a peripheral edge extending therebetween, said peripheral edge of said third plate being coupled to said first surface of said first plate.

8. The system according to claim 7, wherein said third plate has a fifth aperture extending through said primary surface and said secondary surface of said third plate, said third plate extending between said front side and said back side of said first plate, said third plate being positioned between said third aperture on said first plate and said second lateral side, said third plate being aligned with said second plate such that said fifth aperture is aligned with said fourth aperture.

9. The system according to claim 1, wherein said compression unit comprises said fourth plate having a bottom surface, said fourth plate being elongated between said first end and said second end, said fourth plate having a first bend thereon to define a first end portion of said fourth plate forming an angle with a central portion of said fourth plate, said first bend being positioned closer to said first end than said second end.

10. The system according to claim 9, wherein said fourth plate has a second bend thereon to define a second end portion of said fourth plate forming an angle with said central portion, said second bend being positioned closer to said second end than said first end.

11. The system according to claim 10, wherein said first end has a first slot extending toward said second end.

12. The system according to claim 11, wherein said second end has a second slot extending toward said first end.

13. The system according to claim 12, further comprising said rod being elongated between said primary end and said secondary end, said outer surface being bonded to said bottom surface of said fourth plate, said rod being centrally positioned between said first end and said second end, said plate being centrally positioned between said primary end and said secondary end.

14. The system according to claim 13, wherein said outer surface is threaded adjacent to said secondary end.

15. An engine servicing system for compressing valve springs on an assembled engine, said system comprising:

a motorcycle having an engine, said engine having a cylinder head, an intake valve and an exhaust valve;

a mount being selectively coupled to said cylinder head, said mount comprising:

a first plate having a first surface, a second surface and a perimeter edge extending therebetween, said perimeter edge having a first lateral side, a second lateral side, a front side and a back side, said first plate having a pair of first apertures extending through said first surface and said second surface, each of said first apertures being positioned closer to said first lateral side than said second lateral side, each of said first apertures being spaced apart from each other and being aligned with each other, said first plate having a second aperture extending through said first surface and said second surface, said second aperture being centrally positioned between each of said first apertures, said second aperture being positioned closer to said first apertures than said second lateral side, said first plate having a third aperture extending through said first surface and said second surface, said third aperture being aligned with said second aperture, said third aperture being positioned closer to said second lateral side than said second aperture, said third aperture being elongated between said first lateral side and said second lateral side such that said third aperture has an ovoid shape, a second plate having a primary surface, a secondary surface and a peripheral edge extending therebetween, said peripheral edge being coupled to said first surface of said first plate having said second plate being oriented perpendicular to said first plate, said second plate having a fourth aperture extending through said primary surface and said secondary surface, said second plate extending between said front side and said back side of said first plate, said second plate being positioned closer to said second aperture in said first plate than said third aperture in said first plate, and a third plate having a primary surface, a secondary surface and a peripheral edge extending therebetween, said peripheral edge of said third plate being coupled to said first surface of said first plate having said third plate being oriented perpendicular to said first plate, said third plate having a fifth aperture extending through said primary surface and said secondary surface of said third plate, said third plate extending between said front side and said back side of said first plate, said third plate being positioned between said third aperture on said first plate and said second lateral side, said third plate being perpendicular to said second plate and positioned in spaced relationship parallel to and aligned with said second plate;

a plurality of bolts, each of said bolts extending through said mount and engaging said cylinder head at predetermined points on said cylinder head to retain said mount on said cylinder head; and a compression unit being removably coupled to said mount wherein said compression unit is configured to be manipulated, said compression unit engaging each of said intake valve and said exhaust valve such that said compression unit selectively compresses each of said intake valve and said exhaust valve thereby facilitating each of said intake valve and said exhaust valve to be serviced while said engine is mounted in said motorcycle without removing said cylinder head from said engine, said compression unit comprising:

a rod, said rod being extended perpendicularly through said second plate and said third plate wherein said rod is rotatable relative to each of said second plate and said third plate, said rod having a primary end, a secondary end, and an outer surface extending therebetween, said outer surface having a plurality of intersecting sides adjacent to said primary end wherein said plurality of intersecting sides is configured to be engaged by a wrench to facilitate rotation of said rod, and a fourth plate, said fourth plate having a first end and a second end, said fourth plate being coupled to said rod having said rod being oriented perpendicular to a line extending through said first end and said second end of said fourth plate wherein said fourth plate is pivoted by rotation of said rod relative to said second plate and said third plate, said first end of said fourth plate and said second end of said fourth plate being positioned on opposite sides of said rod wherein the first end and the second end are configured to simultaneously engage a respective one of the intake valve and the exhaust valve.

* * * * *